US012241472B2

(12) United States Patent
Botkin et al.

(10) Patent No.: US 12,241,472 B2
(45) Date of Patent: Mar. 4, 2025

(54) CEILING FAN

(71) Applicant: Hunter Fan Company, Memphis, TN (US)

(72) Inventors: Charles William Botkin, Cordova, TN (US); Bobby Neal Norwood, Oakland, TN (US); Jason Matthew McPherson, Lakeland, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 18/766,133

(22) Filed: Jul. 8, 2024

(65) Prior Publication Data

US 2024/0360835 A1 Oct. 31, 2024

Related U.S. Application Data

(62) Division of application No. 18/240,679, filed on Aug. 31, 2023, now Pat. No. 12,085,083.

(60) Provisional application No. 63/376,164, filed on Sep. 19, 2022.

(51) Int. Cl.

| | |
|---|---|
| ***F04D 25/08*** | (2006.01) |
| ***F04D 29/30*** | (2006.01) |
| ***F04D 29/56*** | (2006.01) |

(52) U.S. Cl.
CPC ..... *F04D 25/088* (2013.01); *F04D 29/30* (2013.01); *F04D 29/563* (2013.01)

(58) Field of Classification Search
CPC ..... F04D 25/088; F04D 29/563; F04D 29/30
See application file for complete search history.

(56) References Cited

U.S. PATENT DOCUMENTS

| | | | | |
|---|---|---|---|---|
| 9,719,525 | B2 * | 8/2017 | Cunnane | F04D 29/441 |
| 10,989,207 | B2 * | 4/2021 | Kraft | F04D 29/005 |

* cited by examiner

*Primary Examiner* — Sabbir Hasan
(74) *Attorney, Agent, or Firm* — McGarry Bair PC

(57) ABSTRACT

A ceiling fan or ceiling fan includes a body defining an interior passage having an inlet and an outlet provided on the body. The inlet, outlet, and interior passage can be annular. An impeller is mounted within the interior passage and driven by a motor mounted within the body to draw a volume of air through the interior passage from the inlet to the outlet. A movable deflector including an inner angled surface and a lower angled surface is provided at the outlet to direct the airflow in a generally outward or generally downward direction, respectively.

6 Claims, 15 Drawing Sheets

CEILING FAN

CROSS-REFERENCE TO RELATED APPLICATION(S)

This application is a divisional of U.S. patent application Ser. No. 18/240,679, filed Aug. 31, 2023, now allowed, which claims the benefit of U.S. Provisional Patent Application No. 63/376,164, filed Sep. 19, 2022, both of which are incorporated herein by reference in their entirety.

TECHNICAL FIELD

This disclosure relates to the field of ceiling fans, and more specifically, to impeller-type ceiling fans.

BACKGROUND

Ceiling fans can include a set of blades rotatably coupled to a motor assembly to rotate the set of blades. Rotation of the set of blades drives a volume of fluid, typically ambient air within a room, space, or area. Ceiling fan blades include a traditional aesthetic, commonly having a centralized rotating motor, for rotatably driving a set of blades mounted to the motor. The blades are mounted externally of the motor housing and are visible to the user.

A less common form of ceiling fan is an impeller-type ceiling fan, which uses an impeller within a housing, making the impeller invisible to the user. All the user sees is the exterior housing, which can be provided an aesthetically desirable shape, which is some instances is in the shape of a medallion.

Air flow control through the impeller-type ceiling fan as compared to the traditional ceiling fan is different, especially regarding the recirculation of air within the room. The impeller-type ceiling fan tends to have more complex air flow.

BRIEF DESCRIPTION

In one aspect, the disclosure relates a ceiling fan including a body defining a plenum with an inlet opening and an outlet opening, an impeller having multiple a set of blades located within the plenum, a primary air flow path passing through the plenum from the inlet opening to the outlet opening, a secondary air flow path extending from the inlet opening to the outlet opening and bypassing the a set of blades, and a deflector moveable between a first position, where air from the primary main air flow path is directed downwardly, and a second position, where the air from the primary air flow path is directed radially, without closing the secondary air flow path in either of the first position or the second position.

In another aspect, the disclosure relates to a ceiling fan having a body including a shroud partially defining a plenum fluidly connecting an upstream inlet to a downstream outlet to define a primary air flow path, a motor disposed within the shroud, an impeller disposed within the plenum and having a plurality set of blades rotatably driven by the motor, the impeller partially defining a secondary air flow path bypassing the set of blades, and a deflector arranged at the outlet and movable between a first upper position and a second lower position.

DETAILED DESCRIPTION

Figure 1:
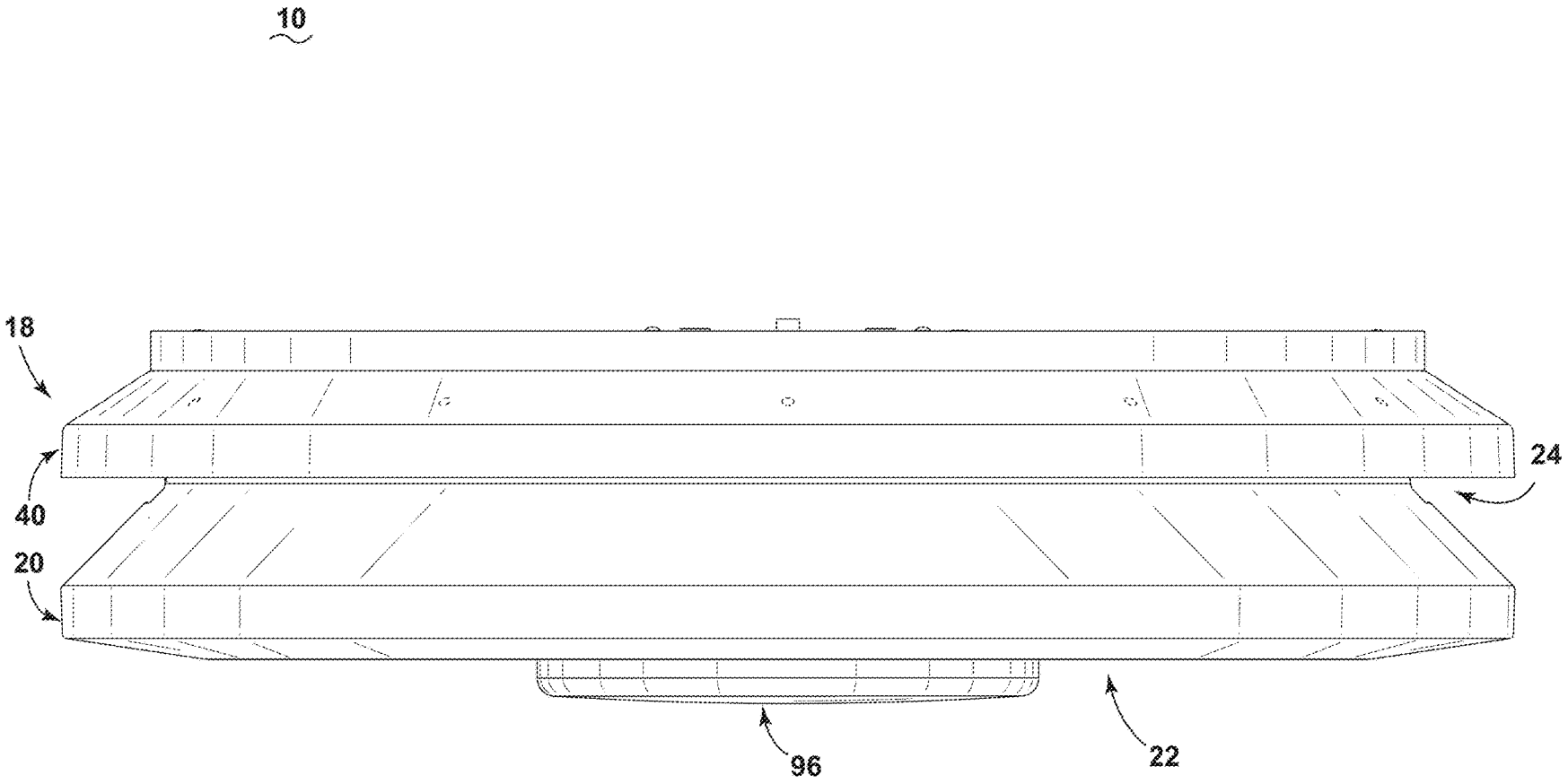
FIG. 1 is a side view of an assembled ceiling fan, of the impeller-type, according to the Description.

The disclosure provided herein relates to a ceiling-mounted fan or a ceiling fan, and more specifically, to an impeller-type ceiling fan having an impeller, contained within a housing, to drive an airflow as opposed to a traditional ceiling fan having a set of radially-extending blades, external to a housing, and open to the environment. It should be understood that the impeller includes a set of mounted blades, but can be formed as a singular unit for driving a circumferential airflow, as opposed to individual blades each driving an airflow individually.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. A generally downward direction can be defined as a direction that is directed more away from the ceiling or structure from which the ceiling fan suspends, than in a direction toward the ceiling. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary. As used herein, the term "set" or a "set" of elements can be any number of elements, including only one. For example, a set of grommets or a set of blades as used herein can include one or more grommets, or one or more blades.

Referring to FIG. 1, a ceiling fan 10 can include a body 18 that includes an inlet housing 20 and a deflector 40, which is moveable relative to the inlet housing. In a non-limiting example, each of the inlet housing 20 and deflector 40 can have an annular shape and they can have a generally identical ornamental appearance. Additionally, and alternatively, the inlet housing 20 and the deflector 40 can have a generally dissimilar appearance. The inlet housing 20 defines an inlet 22 for drawing airflow into the body 18. An outlet 24 can be provided on the side of the body 18, with the deflector movable relative to the outlet 24 to control the direction of the air emitted through the outlet 24. An optional light kit 96 can be carried by the body 18, such as suspended from the inlet housing 20. In one example, a controller (not shown) can be provided within the inlet housing 20, which can be utilized for controlling or operating the ceiling fan 10. In alternative non-limiting examples, a controller can be provided remote from the ceiling fan, such as a wall-mounted controller or a wireless controller.

Figure 2:
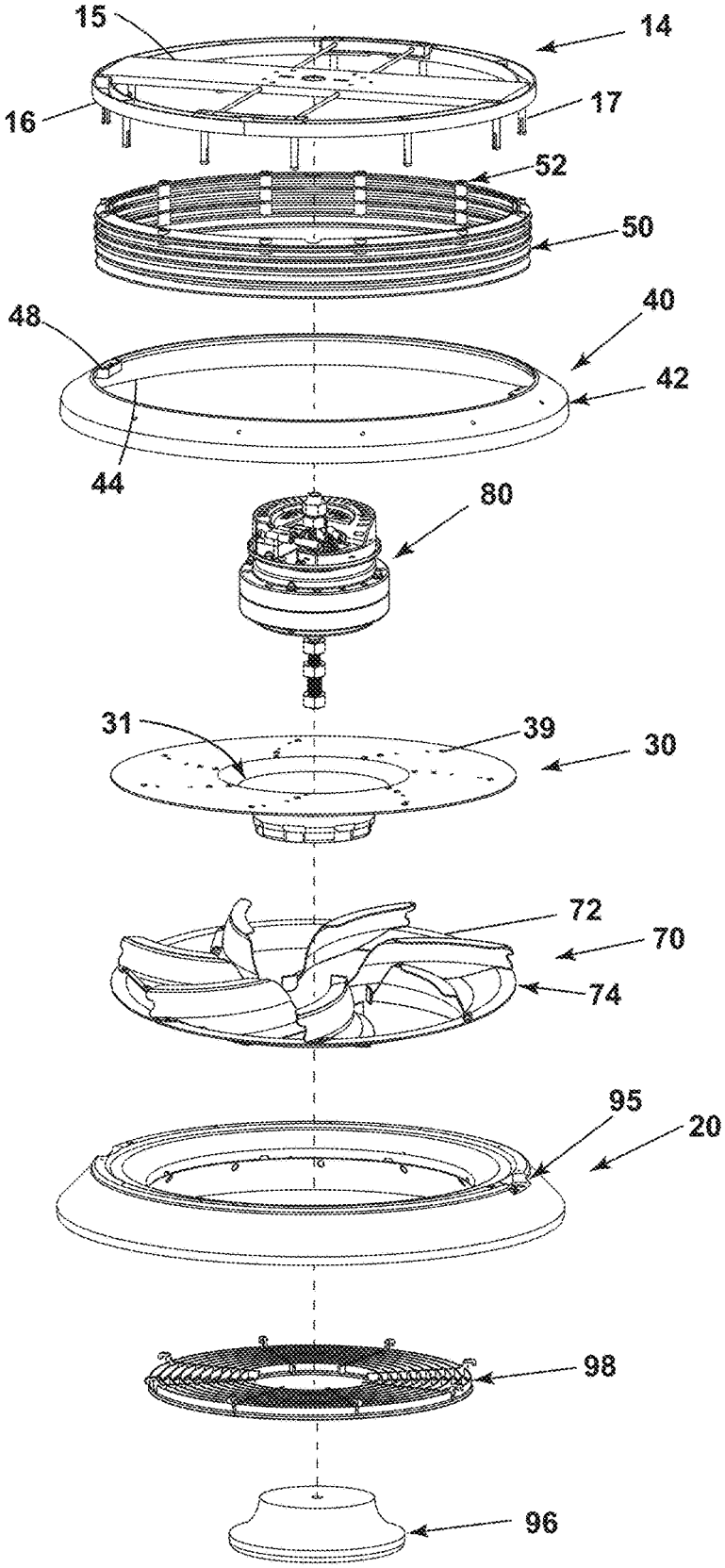
FIG. 2 is an exploded view of the ceiling fan of FIG. 1 illustrating the major components of outlet frame, guide vanes, deflector, shroud, motor, impeller, inlet housing, inlet grill, light kit.

Turning now to FIG. 2, the major components of the ceiling fan 10 can be seen in a partially exploded view and include, in stacked arrangement, an outlet frame 14, a set of guide vanes 50, the deflector 40, a motor 80, a shroud 30, an impeller 70, the inlet housing 20, an optional inlet grill 98, and the optional light kit 96.

Figure 3:
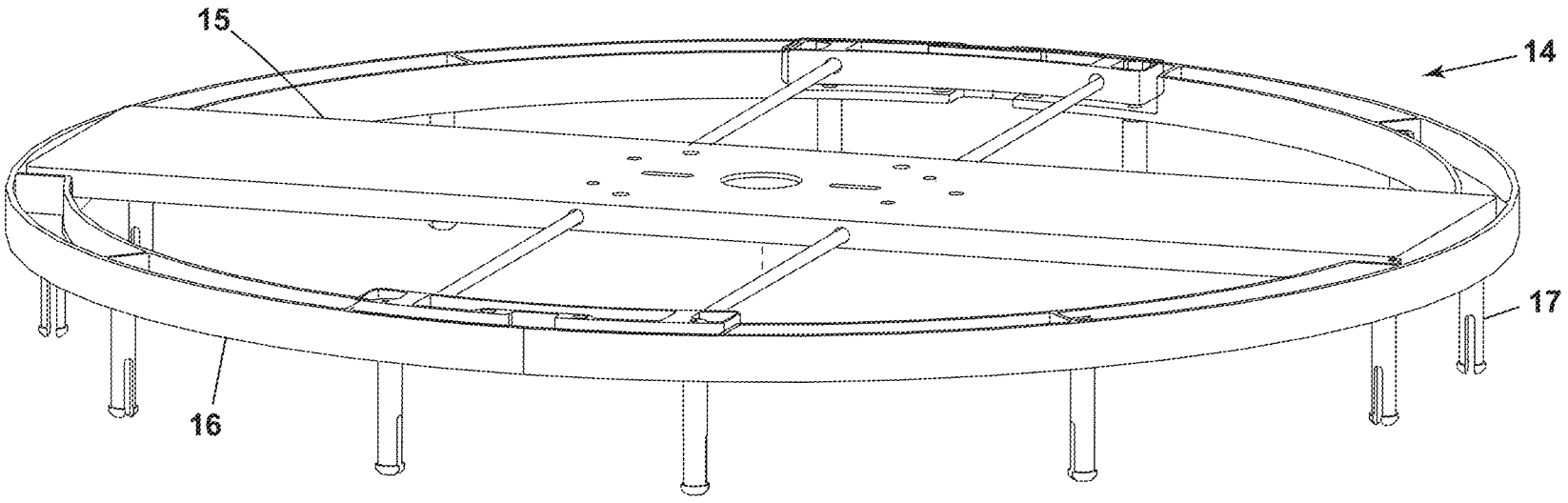
FIG. 3 is a perspective view of the outlet frame of FIG. 2.

Referring to FIG. 3, the outlet frame 14 is illustrated as including a beam 15, a ring 16, and a set of posts 17, where the beam 15 extends diametrically across the ring 16. The beam 15 can also function as a mounting bracket to secure the body 18 to a structure, such as a ceiling. Rods can be provided transverse to the beam 15 to provide additional structural support.

Figure 4:
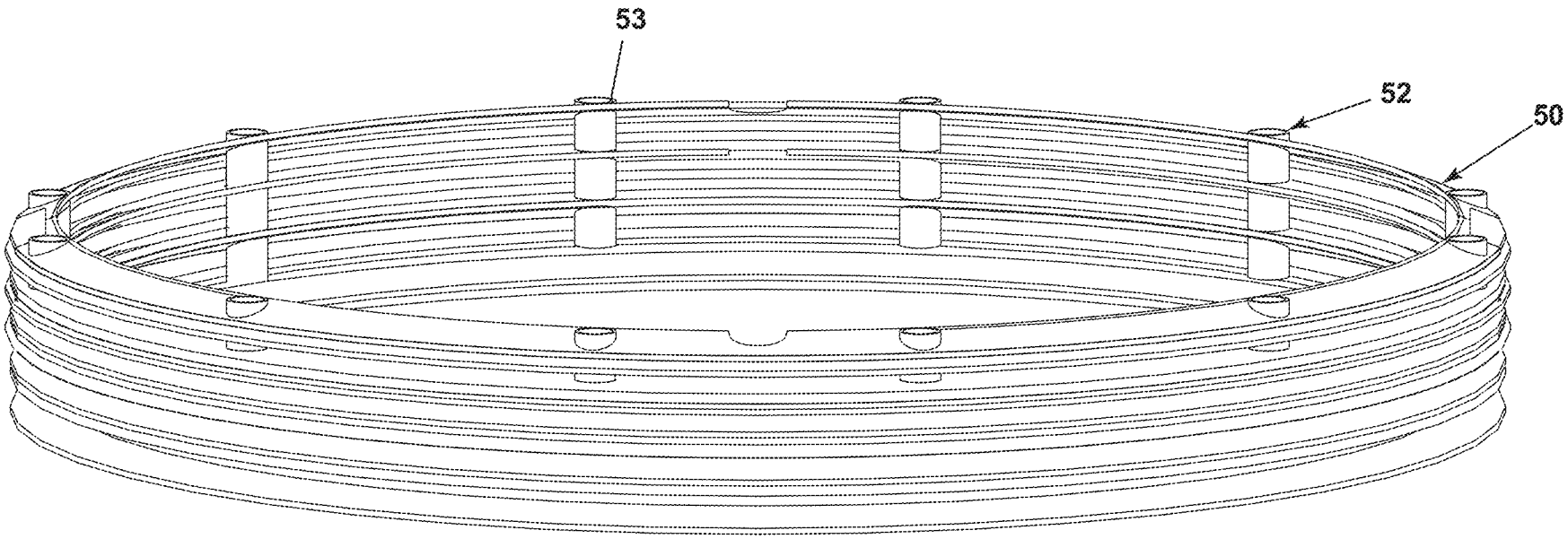
FIG. 4 is a perspective view of the guide vanes of FIG. 2.

Referring to FIG. 4, the set of guide vanes 50 can include spaced, stationary foils, louvers, airfoils, or the like. For example, the set of guide vanes 50 can be a set of louvers in the form of vertically stacked, slanted rings. The set of guide vanes 50 can be connected by a set of receiving posts 52, which can be spaced circumferentially about the set of guide vanes 50. The set of receiving posts 52 can include openings 53 that receive the posts 17 of the outlet frame 14 (FIG. 3). The posts 17 (FIG. 3) can extend through the receiving posts 52 and couple to the inlet housing 20 (FIG. 2).

In this non-limiting example, the set of guide vanes 50 is illustrated as including three vertically spaced rings, however, it is contemplated that the set of guide vanes 50 can include any number of vanes or spaced rings. Each vane of the set of guide vanes 50 can be orientated at an angle relative to the horizontal. Each vanes of the set of guide vanes 50 can have the same angle or different angle relative to the horizontal. The angle can be a non-zero angle relative to the horizontal or vary between 15 to −15 degrees relative to the horizontal. Additionally, or alternatively the angle of one or more vanes of the set of guide vanes 50 can be between 30 and −30 degrees or between 0 and −30 degrees when the ceiling fan is mounted to a horizontal surface. That is, optionally, the non-zero angle relative to the horizontal of one or more vanes of the set of guide vanes 50 can be below the horizon or below 0 degrees and equal to or above-30 degrees. Yet, another option would be a vertical orientation for the set of guide vanes. The illustrate guide vanes 50 show the guide vanes as horizontally-oriented rings, where the angle can vary relative to the horizontal. However, in a vertical orientation, the rings would be replaced by a plurality of vertical vanes circumferentially spaced about the periphery of the outlet. Each of the vertical vanes will have a body axis, when viewed from a horizontal plane, and the body axis can form an angle relative to a ray line emanating from the rotational axis of the fan. The body axis can be one and the same as the chord line or mean camber line for the guide vane. The vertical vanes can also have a span-wise axis, extending from the root to the tip, and, when the vertical vane is completely vertical, the span-wise axis is parallel to the vertical. However, the vanes can be angled off vertical, such that the span-wise axis forms an angle relative to the vertical.

Figure 5:
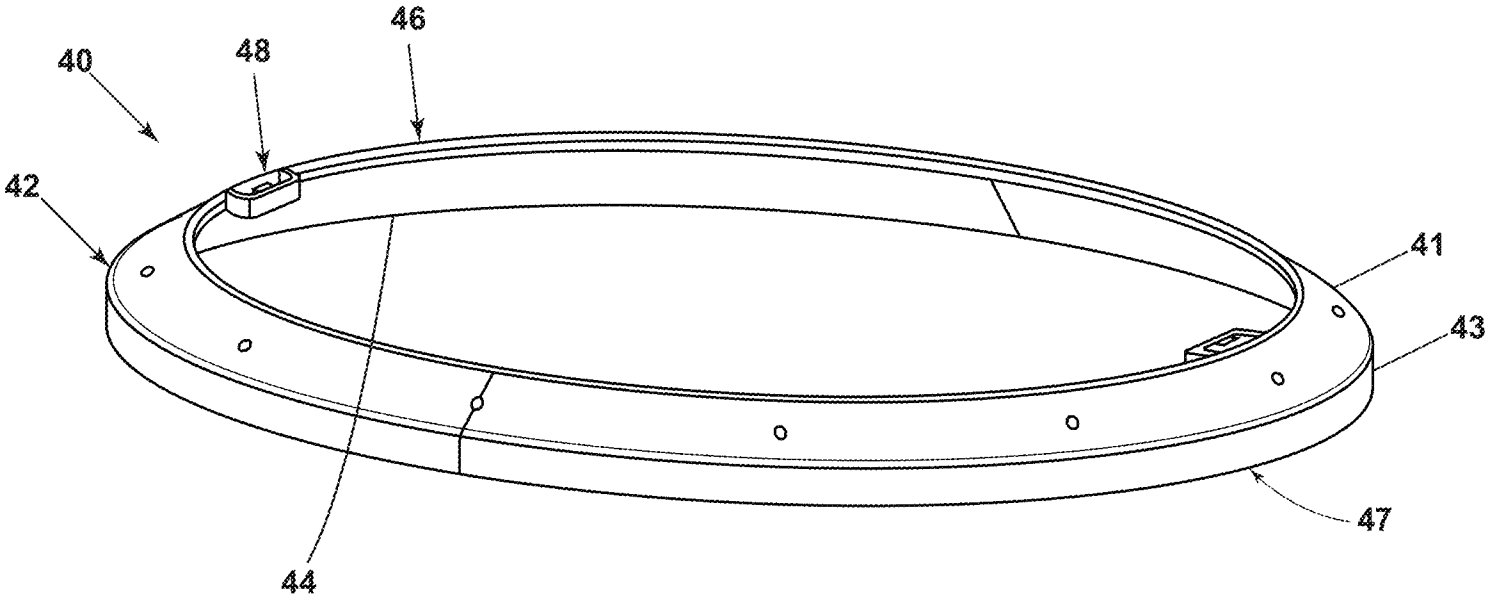
FIG. 5 is a perspective view of the deflector of FIG. 2.

Referring now to FIG. 5, the deflector is shown having an inner rim 46 from which extends an exterior surface 42 and an interior surface or lower angled surface 44. The exterior surface 42 can have a downwardly sloping portion 41 and a lower vertical portion 43 in one non-limiting example. Alternatively, and additionally, the exterior surface 42 can have a downwardly curved shape. The lower angled surface 44 is shown as an angled surface, which is flared outwardly from the inner rim 46 and meets the vertical portion 43 at an outer rim 47. A locking assembly or a set of lugs 48 extend from inner rim 46 and function as alignment keys to index the position of the deflector 40 with the inlet housing 20. The set of lugs 48 can extend radially inward from the inner rim 46 and be coupled to or formed with the inner rim 46.

Figure 6:
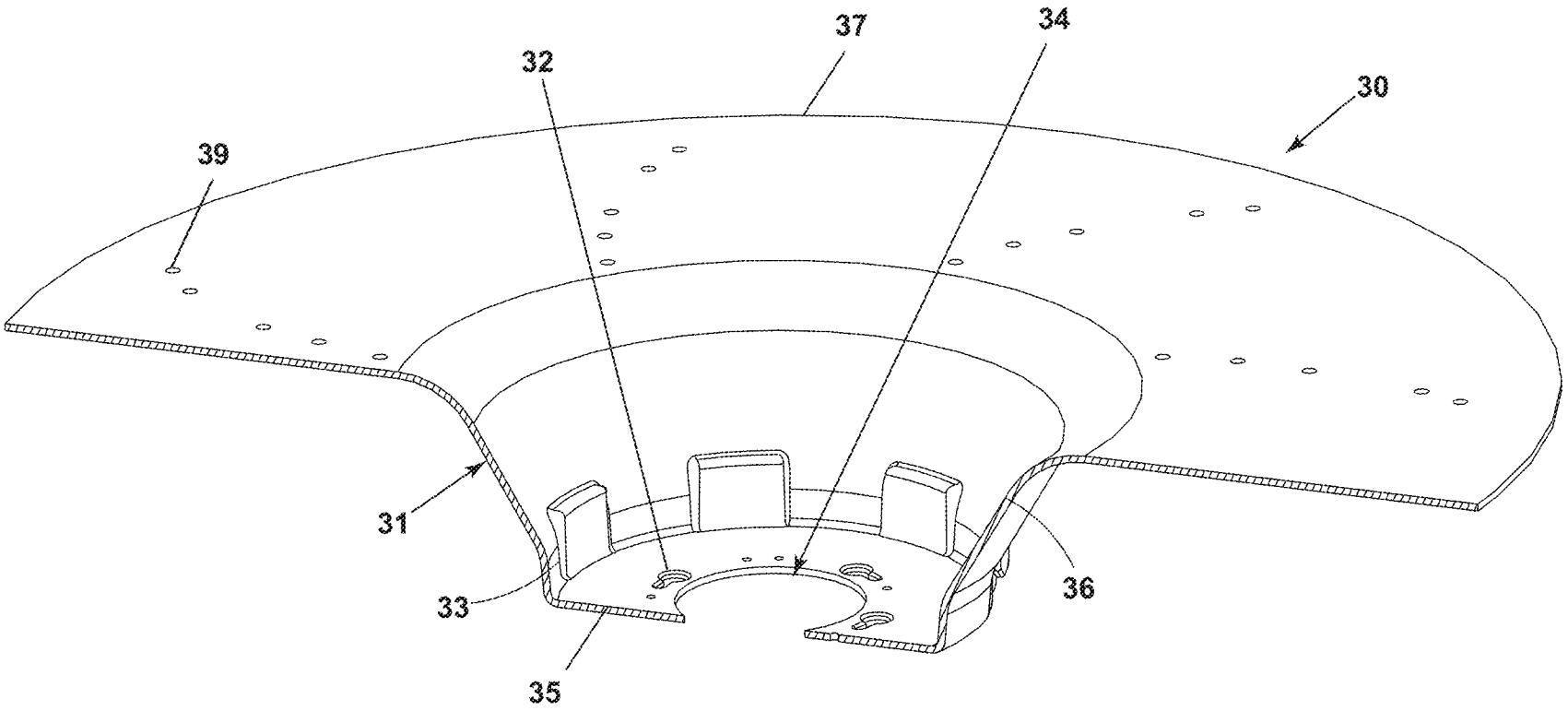
FIG. 6 is a diametric, perspective view of shroud of FIG. 2.
Figure 11:
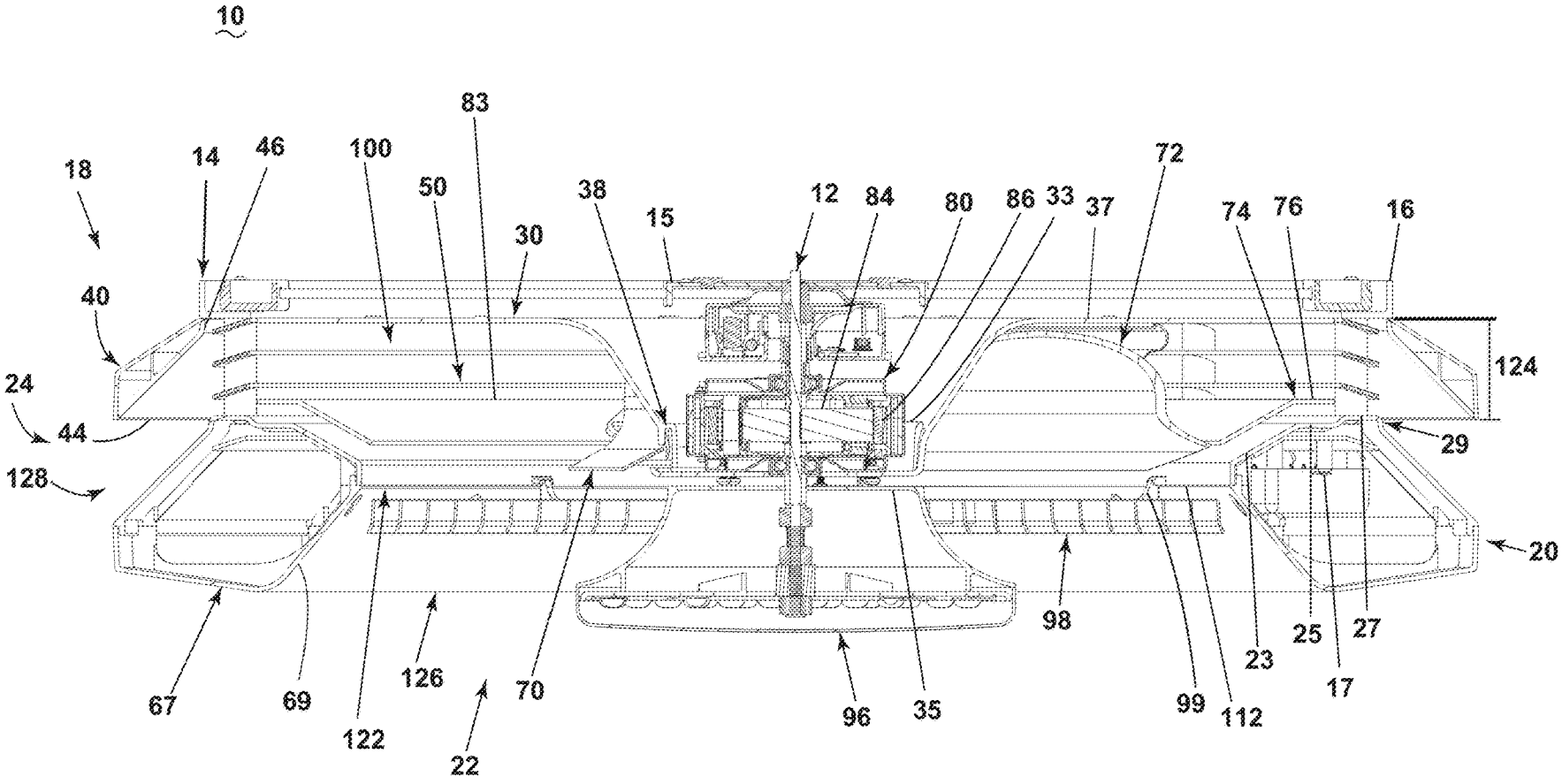
FIG. 11 is a cross-sectional view of the ceiling fan of FIG. 1 with a deflector in a first position, where air exiting the ceiling fan is directed downwardly and away from the ceiling fan.

Referring to FIG. 6, the shroud 30 is shown in a diametric sectional view, which illustrates the truncated, cone-like sloped portion 31, which transitions to a flat portion 37. The truncated, cone-like sloped portion or cone portion 31 terminates in a central floor 35, which collectively forms a motor chamber 36 for receiving the motor 80, with the motor 80 resting on and/or coupled to the central floor 35. The central floor 35 has mounting openings 32 and a drive shaft opening 34 for securing the motor 80 to the central floor 35 and permitting passage of a motor shaft or drive shaft 12 of the motor, respectively. A plurality of lugs 33 can be spaced circumferentially about the central floor 35. The backside of the lugs 33 can form a seat 38 (FIG. 11). The lugs can be used to locate the impeller 70 relative to the cone portion 31. A set of fastener openings 39, used in coupling the impeller 70 to the shroud, amongst other possibilities, can be provided in the shroud 30.

Figure 7:
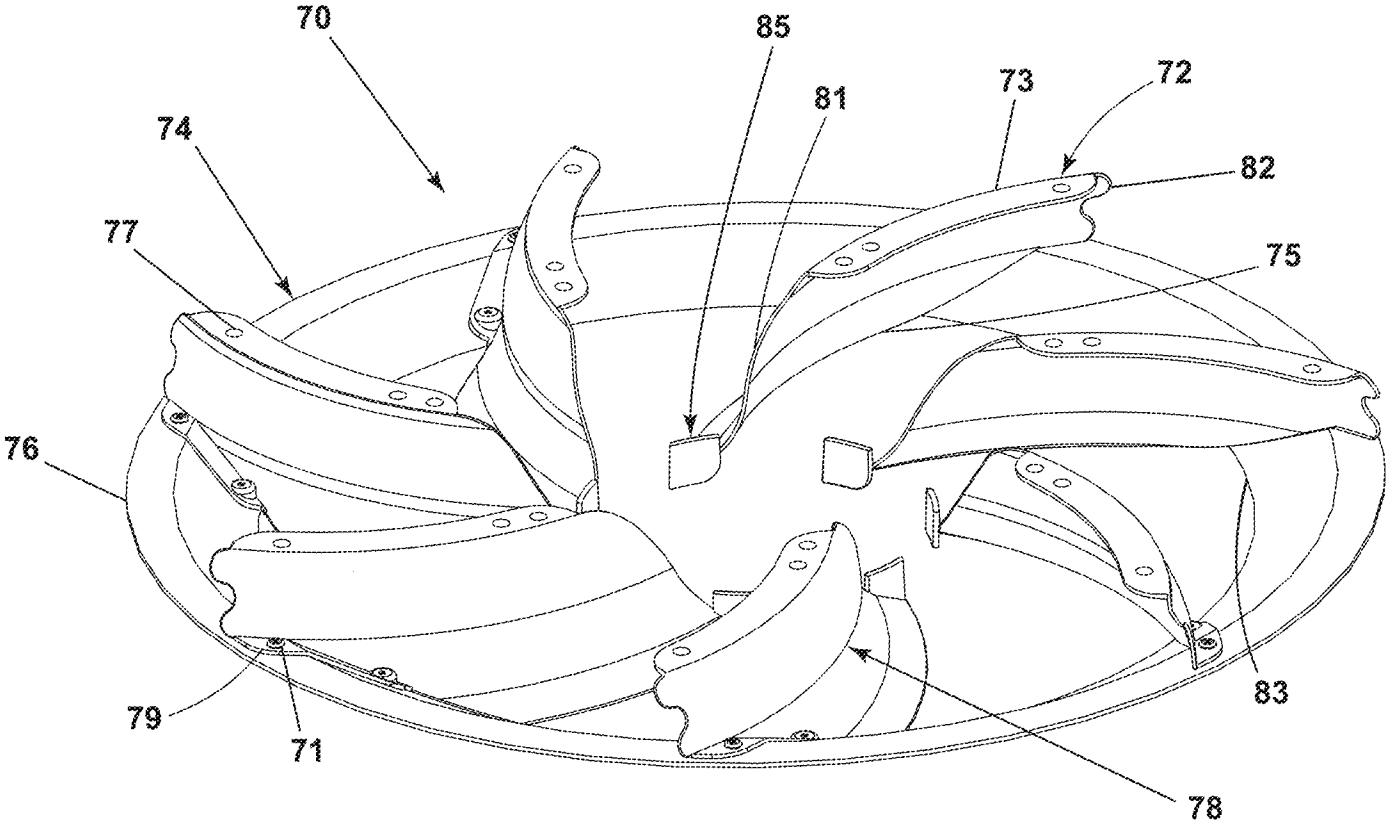
FIG. 7 is a top view of the impeller of the ceiling fan of FIG. 2.

Referring to FIG. 7, the impeller 70 includes a set of blades 72 mounted to an outer ring 74. While shown as including seven blades, the set of blades 72 can include any number of blades including one blade. Each of the blades 72 extends from a root 81 to a tip 82, which are connected by a top edge 73 and a bottom edge 75, thereby defining the boundary of the blades 72. The blades 72 define a curved body 78 bounded by the root 81, the tip 82, the top edge 73, and the bottom edge 75. Each of the blades 72 can have a tab 79 near the tip 82, which, along with a set of fasteners 71, can secure the blades 72 along the bottom edge 75 to the outer ring 74. In this way, the blades 72 are coupled to or cantilevered mounted to the outer ring 74 by the tips 82, with the root 81 being free. It is contemplated that the outer ring 74 can have a flat edge portion 76 for fixing the blades 72. The outer ring 74 can further include a sloped portion 83 radially interiorly of the flat edge portion 76 for guiding the airflow to the blades 72 to reduce drag or stagnation. The blades 72 have a set of openings 77 along the top edge 73, some of which can align with the set of fastener openings 39 of the shroud 30 (FIG. 6), with fasteners passing through the aligned openings 77, 39 to secure the impeller 70 to the shroud 30. Additionally, and alternatively, the blades 72 can be formed integrally with either the outer ring 74 or the shroud 30. The roots 81 of the blades 72 abut the cone portion 31 of the shroud 30. The roots 81 can have a tab 85, which can be secured, by receipt in the seat 38 (FIG. 11) formed by the backside of the lugs 33 or by a suitable fastener, to the cone portion 31. Since the interior of the outer ring 74 is open, air is free to flow through the interior of the outer ring 74 between the blades 72.

Figure 8:
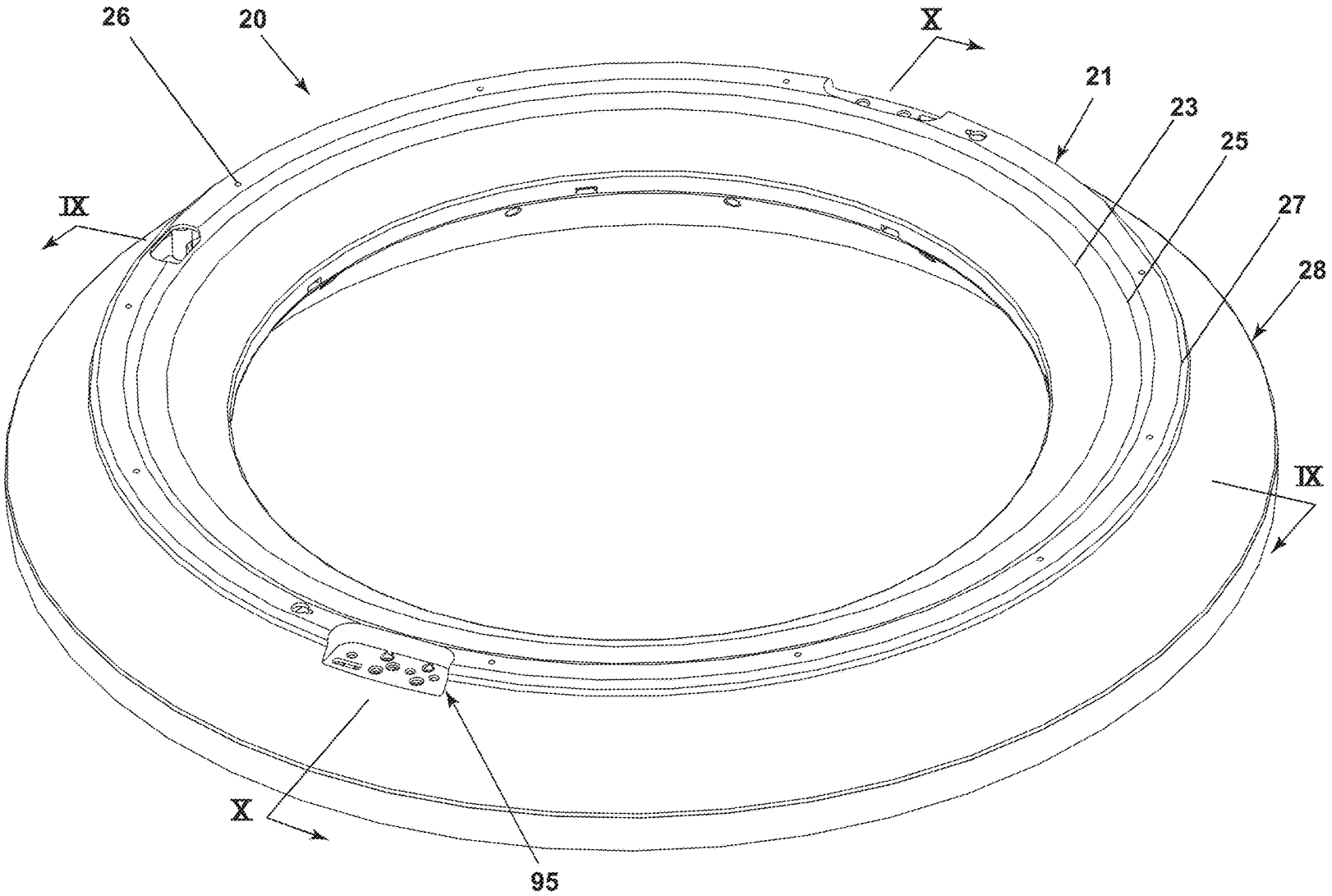
FIG. 8 is a top perspective view of the inlet housing of FIG. 2.

Turning now to FIG. 8, the inlet housing 20 can include a top rim 21. An inner angled surface 23 can be included in inlet housing 20, sloping downwardly and inwardly away from the top rim 21. In one non-limiting example, the top rim 21 can include a first surface 25 spaced radially and vertically from a second surface 27, such that the surfaces 25, 27 define steps. The first and second surfaces 25, 27 can be generally flat. Additionally, and alternatively, the first surface 25 can be sloped or curved. An angled exterior surface 28 can extend outwardly from the top rim 21, angled in a downward direction. It should be appreciated that the top rim 21 can incorporate any combination of raised surfaces, steps, sloped, and curved features. A set of key ways in the form of receptacles 95 are provided in the inlet housing 20. The receptacles 95 are recessed into the top rim 21 and face or open outward. The receptacles 95 are located and sized to receive the set of lugs 48 of the deflector 40 to index or locate the deflector 40 relative to the inlet housing 20.

Figure 9:
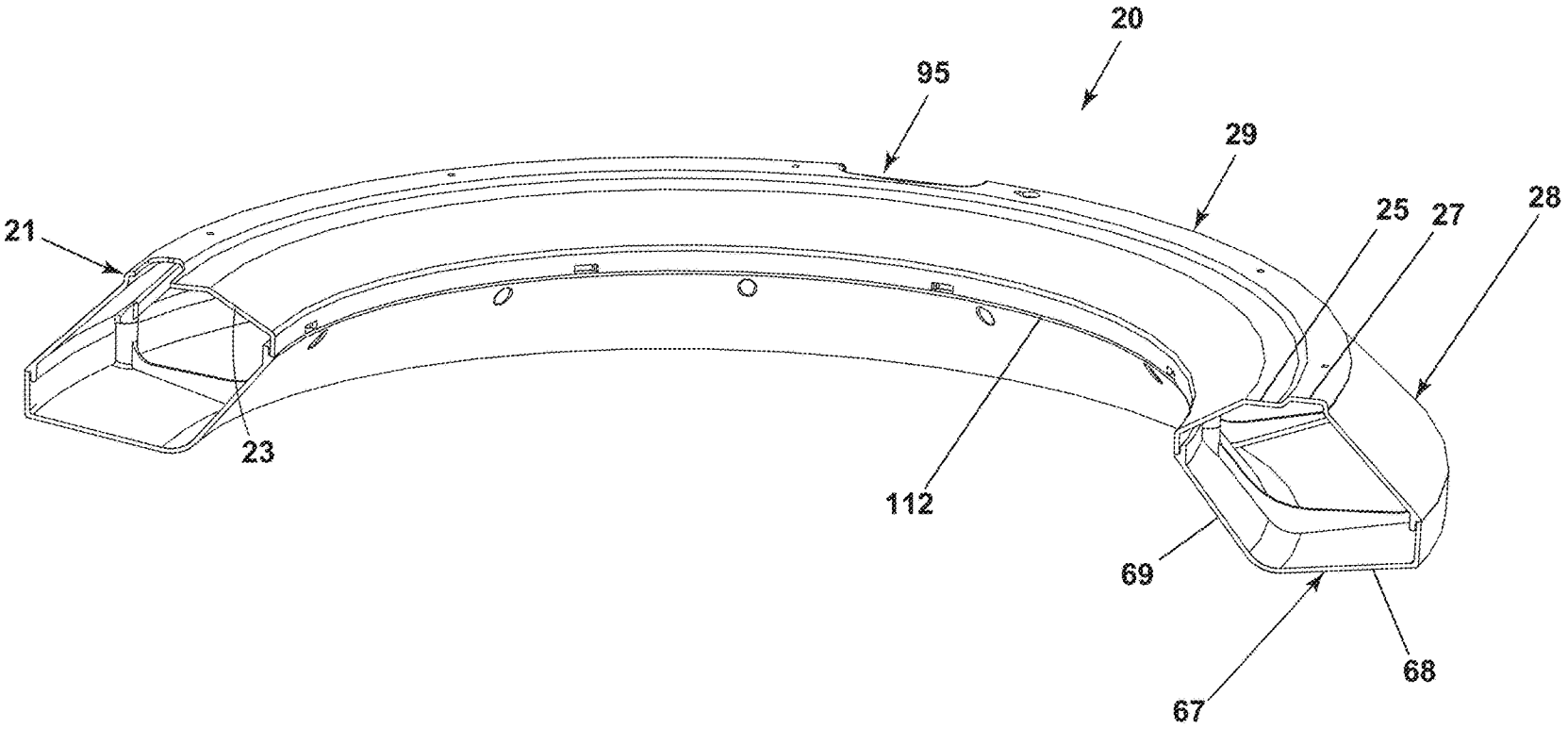
FIG. 9 is a sectional view of the inlet housing of the FIG. 8.

Referring now to FIG. 9, additional details of the inlet housing 20 can be seen. The second surface 27 can be raised from the first surface 25 to define a step or a raised portion 29. The angled surface 23 is spaced from the second surface 27 by the first surface 25. Opposite the exterior surface 28, the inlet housing 20 can include a lower surface 67. In one non-limiting example, the lower surface 67 can include an outwardly sloping portion 68 and an inwardly sloping portion 69. The inwardly sloping portion 69 defines a partial cone segment, which functions as a converging inlet to the impeller, which will accelerate the air flow because of the convergence. It is contemplated that the lower surface 67 can have any combination of curved, straight, or sloping portions. The lower surface 67 joins the innermost edge of the angled surface 23 at an inner lip 112.

Openings 26 in the top rim 21 or second surface 27 can be used to fasten the inlet housing 20 to, for example, the outlet frame 14. That is, the openings 26 can receive posts 17.

Figure 10:
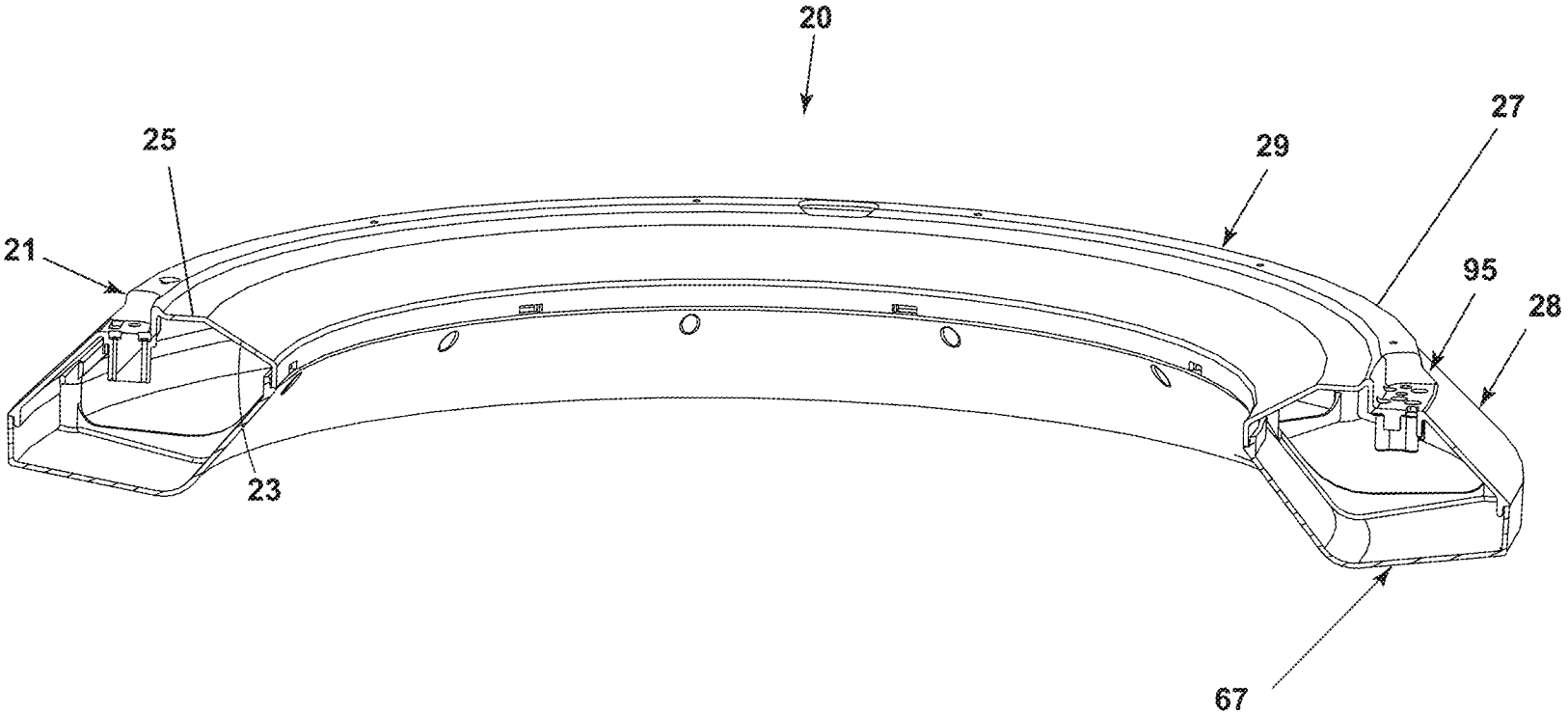
FIG. 10 is another sectional view of the inlet housing of FIG. 8.

FIG. 10 illustrates another sectional view of the inlet housing 20 with the section taken along X-X, through the diametrically opposed receptacles 95, to illustrate the generally rectangular shape of the interior of the receptacles 95. Each of the receptacles 95 can extend across the raised portion 29 and at least partially into the exterior surface 28.

Turning now to FIG. 11, a diametric cross section of the ceiling fan 10 is illustrated to show the relationship between the various components when assembled. The outlet frame 14 is affixed to the inlet housing 20 by the posts 17 of the outlet frame 14 passing through the receiving posts 52 (FIG. 2 and FIG. 4) of the set of guide vanes 50, with the posts 17 then being secured to the inlet housing 20 using suitable fasteners, such as screws, which fixes the position of the set of guide vanes 50 relative to the outlet frame 14 and inlet housing 20.

The shroud 30 is affixed to the outlet frame 14 via the motor 80. That is, one end of the motor 80 is mounted to the central floor 35 of the shroud 30, while the opposing end of the motor is mounted to the beam 15 of the outlet frame 14. It is contemplated that the shroud 30 could be mounted directly to the outlet frame 14, instead of indirectly through the motor 80. The impeller 70 is mounted to the motor 80 such that the sloped portion 83 is axially spaced above the angled surface 23 of the inlet housing 20. The impeller 70 can be mounted directly to the motor 80 or indirectly through the shroud 30. When the impeller 70 is mounted indirectly to the should 30, the shroud is directly mounted to the motor 80, such that the shroud 30 rotates with the impeller 70, which, essentially makes the shroud 30 and impeller 70 an integral unit. The light kit 96 is mounted to the motor 80, but could just as easily be mounted to the shroud 30. The grill 98 is mounted to the inlet housing 20. As shown, the grill 98 has fingers 99 that are received within openings in the inner lip 112 of the inlet housing 20.

With this assembly, the set of guide vanes 50 is positioned between the ring 16 and the inlet housing 20, specifically, the raised portion 29. The set of guide vanes 50 can be arranged and positioned such that the upper most outlet vane of the set of guide vanes 50 seals against the bottom of the ring 16. Furthermore, the flat portion 37 of the shroud 30 is substantially horizontally level with the upper-most vane to effectively, for practical purposes, form a closure with the uppermost vane for air passing through the impeller 70. The impeller 70 is located interiorly to the set of guide vanes 50. The lower-most outlet vane of the set of guide vanes 50 is vertically positioned above the flat edge portion 76 of the outer ring 74. In another non-limiting example, the lowermost outlet vane can be vertically positioned below the flat edge portion 76. The outer ring 74 of the impeller 70 terminates radially interior of the raised portion 29.

The motor 80 can include the drive shaft 12 for driving rotation of the impeller 70. A stator 84 and an external rotor or exterior rotor 86 driven by the stator 84 are included in the motor 80. The exterior rotor 86 couples with the plurality lugs 33 in the shroud 30 to effect rotation of the shroud 30. Since the impeller 70 is mounted to the shroud 30, rotation of the shroud 30 effects rotation of the impeller 70. The exterior rotor 86 provides for non-rotation of the drive shaft 12, which enables the drive shaft 12 to connect the motor 80 to the outlet frame 14 and the light kit 96.

With this configuration, the body 18 defines a plenum 100 that is bounded by the shroud 30 and the inlet housing 20, specifically the surfaces 23, 25, and 27 of the inlet housing 20. The impeller 70, along with the blades 72, are located within the plenum 100. The plenum 100 fluidly connects the inlet 22 and the outlet 24, such that air moved through the body 18 by the rotating impeller 70, enters the inlet 22, passes through the plenum 100, and then exits the outlet 24.

The inlet 22 can include an inlet opening 122 defined by the inner lip 112 of the inlet housing 20. The inlet opening 122 can be described as a two-dimensional, generally circular opening. The inlet 22 can include an inlet passage 126, which includes the inwardly sloping portion 69 defining the converging portion, such that air flow is accelerated toward the inlet opening 122. The converging portion can be thought of as an inlet nozzle.

Other features such as the light kit 96 can provide a part of the surface boundary for the inlet passage 126. The inlet passage 126 can also include the grill 98, which can have surfaces for controlling the air flow entering the inlet 22 upstream of the inlet opening 122. For example, the grill 98 can include a set of louvers to direct the incoming air. In a non-limiting example, the grill 98 can support a filter covering at least a portion of the inlet 22 to filter the air drawn into the inlet 22.

The outlet 24 includes an outlet opening 124 shown to include a gap that extends between the shroud 30 and the raised portion 29. In other words, the outlet opening 124 has a generally cylindrical shape, for example following the peripheral gap between the ring 16 and the raised portion 29.

The outlet 24 can include an outlet passage 128. The outlet passage 128 can include the space near the outlet opening 124. For example, the outlet passage 128 can include space around and between the set of guide vanes 50. The outlet passage 128 can be at least partially defined by the lower angled surface 44 when the deflector 40 is in a first upper position or a first position as shown in FIG. 11.

Figure 12:
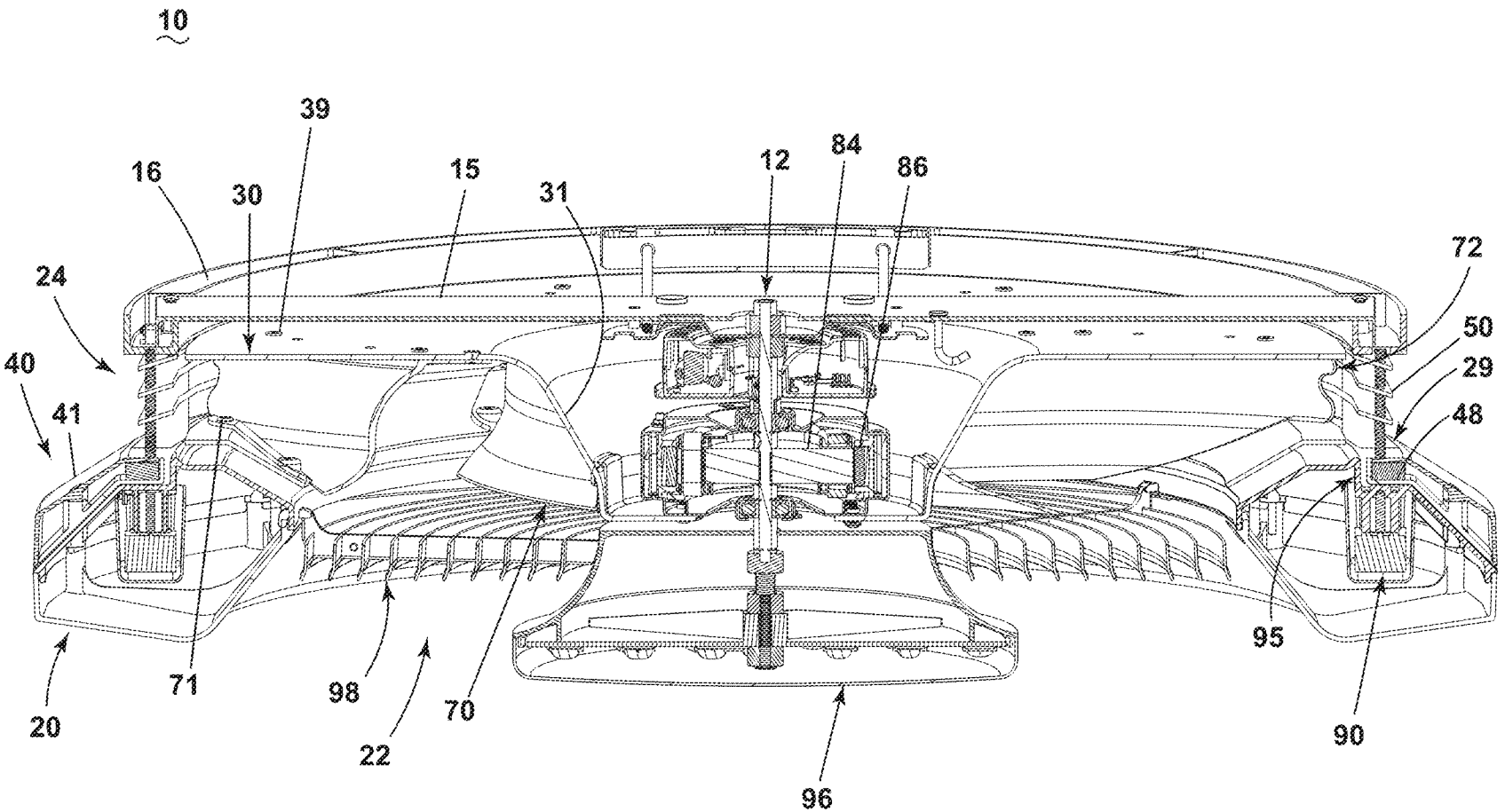
FIG. 12 is a top perspective view of a second cross-section of the ceiling fan of FIG. 1 with a deflector in a second position.

Turning now to FIG. 12, the ceiling fan 10 is shown with the deflector 40 in a second lower position or a second position, moved vertically downward from that of the first position as shown in FIG. 11. Some of the blades 72 have been removed for clarity or truncated due to the perspective sectional view. The deflector 40 can be moved to and held in the second position by an actuator 90. In one example, the actuator 90 can be a threaded shaft, which can be used to manually or automatically adjust the position of the deflector 40 by twisting movement of the threaded shaft. Adjusting the deflector 40 can include raising or lowering the deflector 40, for example.

In the second position, the set of lugs 48 are received within the set of receptacles 95 such that the set of lugs 48 are flush with the raised portion 29. The actuator 90 can be housed within the inlet housing 20 at the set of receptacles 95. The actuators 90 or guides thereof can mount to and extend from the receptacles 95 in the inlet housing 20, and extend to the shroud 30 to permit movement of the deflector 40 between the shroud 30 and the inlet housing 20. It should be understood that other implementations are possible, and other methods of positioning the deflector 40 are contemplated. In one example, the actuator 90 can be a mechanical actuator controlled by a controller, which can be used to mechanically move the deflector between the first position (FIG. 11) and the second position (FIG. 12). In another example, the actuator can be a manually operated, where the user can manually change between the first position and the second position, or positions therebetween.

Figure 13:
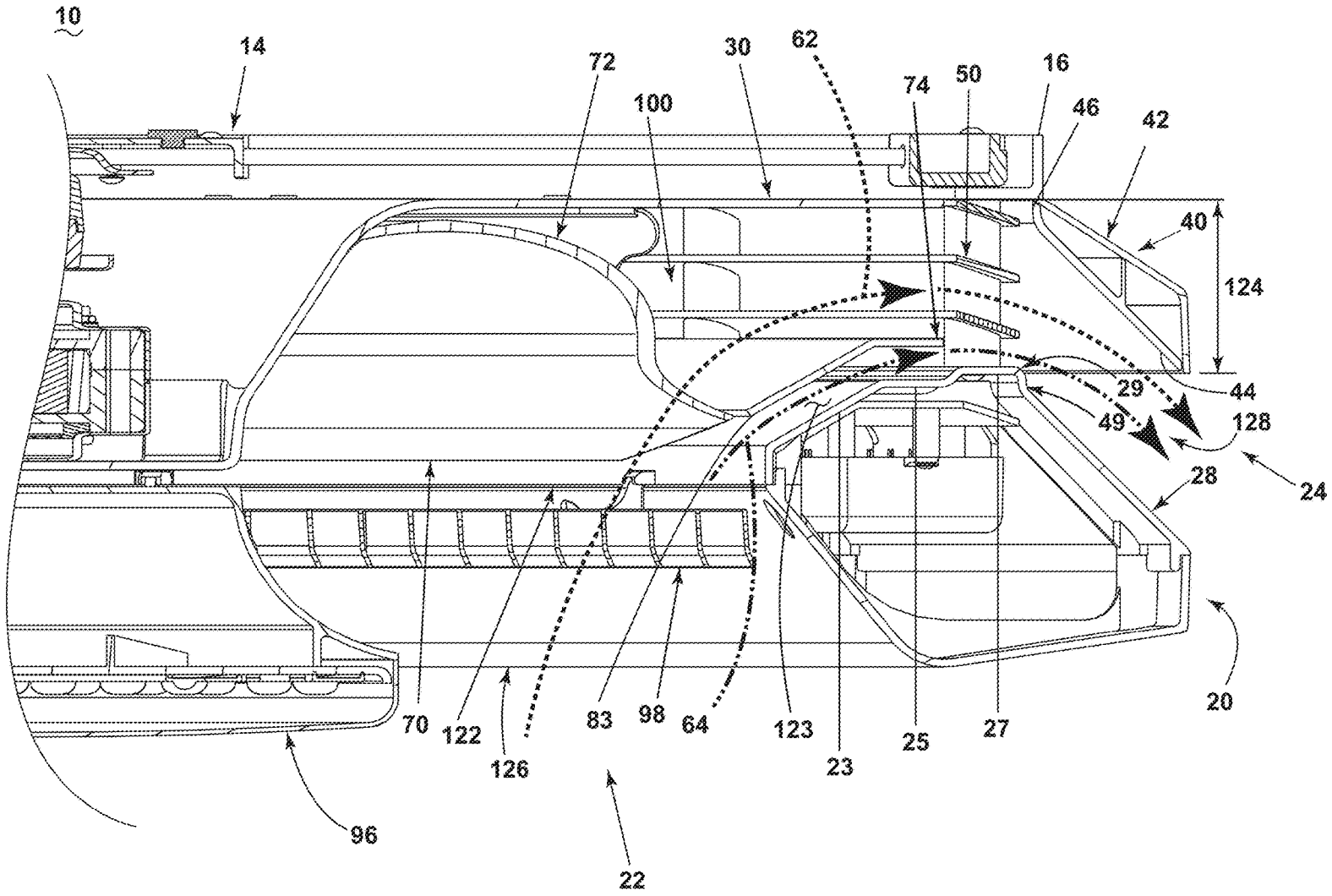
FIG. 13 is an enlarged detail view of the ceiling fan of FIG. 1 with a deflector in a first position.
Figure 14:
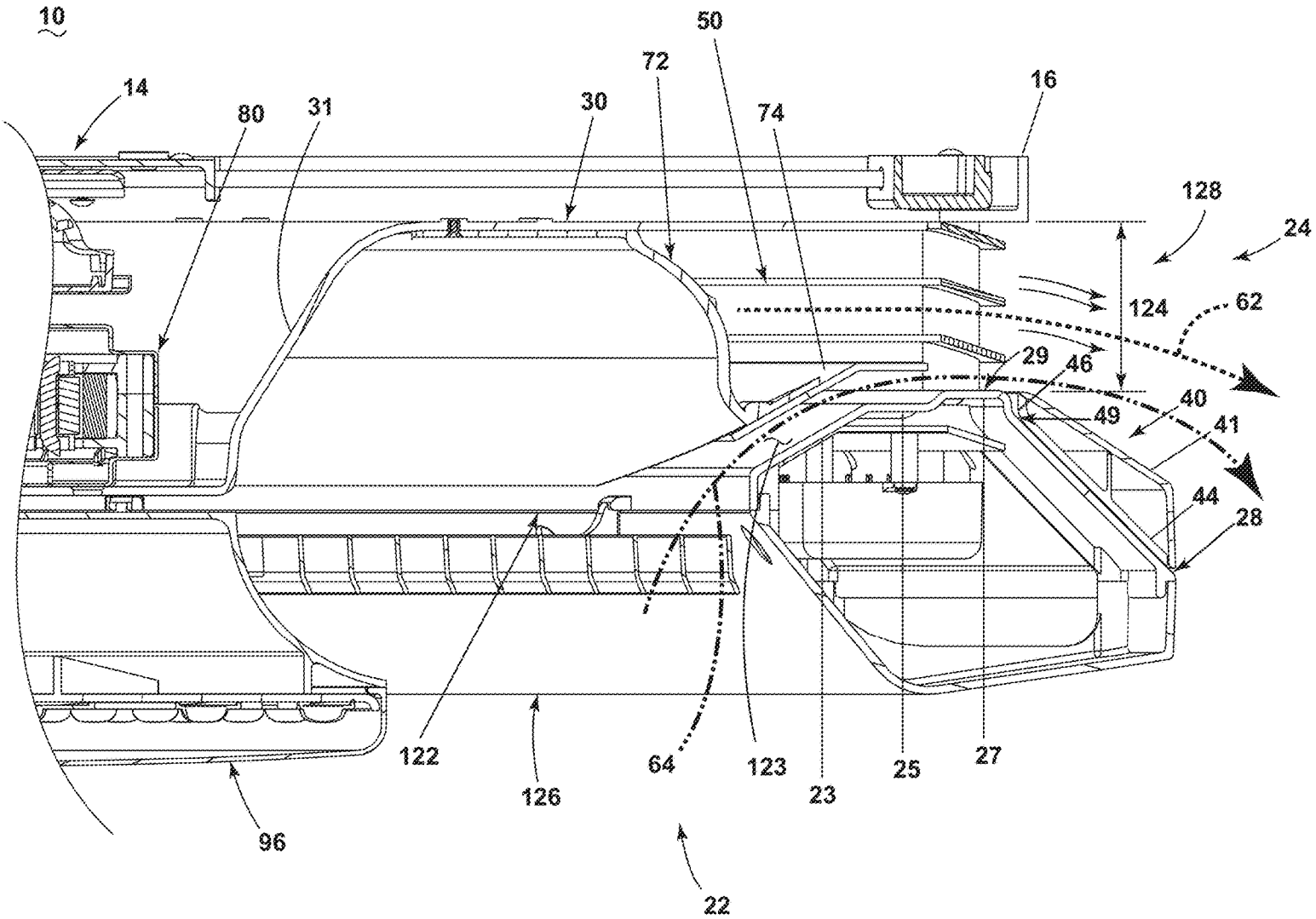
FIG. 14 is an enlarged detail view of the ceiling fan of FIG. 1 with a deflector in a second position.

Turning now to FIGS. 13 and 14, the airflow through the ceiling fan 10 will be described in more detail. While FIGS. 13 and 14 illustrate only a portion of the ceiling fan 10, the description applies to the entire ceiling fan 10 due to the circular/annular shape of the ceiling fan 10. A primary air flow path or a primary air flow passage can be defined as extending between the inlet opening 122 and the outlet opening 124, while passing through the plenum 100. Air flowing along the primary air flow passage is identified as a primary air flow 62.

A secondary air flow path or a secondary air flow passage, which bypasses the blades 72, is defined by the inlet opening 122, the outlet opening 124, and a space or interior passage 123 formed between the sloped portion 83 of the impeller 70 and the sloped surface 23 of the inlet housing 20. Air flowing along the secondary air flow passage is identified as secondary air flow 64. As illustrated, the secondary air flow 64 bypasses the blades 72 of the impeller 70.

In one non-limiting example, the secondary air flow 64 can begin at the inlet passage 126, flowing through the grill 98 and inlet opening 122. The secondary air flow 64 can continue beyond the inlet opening 122 between the outer ring 74 and inner angled surface 23, over the raised portion 29 to exhaust through the outlet 24. It is contemplated that the inlet housing 20 can include any combination of raised, sloped, and curved portions to effectively guide airflow along the primary air flow 62 or the secondary air flow 64.

In the configuration shown in FIG. 13, where the deflector 40 is in the first position, the air flow through the outlet passage 128 is directed by the set of guide vanes 50, the lower angled surface 44, and the exterior surface 28. By way of non-limiting examples, the lower angled surface 44 can include a curve or sloped surface or include steps to direct airflow in a generally downward direction. The contoured step as defined by the raised portion 29 reduces the cross-sectional area of the secondary air flow path, which accelerates the secondary air flow 64 and enhances the flow attachment of the secondary air flow 64 due to the Coanda effect. The acceleration also provides the secondary air flow 64 with improved performance as an air curtain or shield.

It is contemplated that the exterior surface 28 and the lower angled surface 44 can have any combination of sloped or curved surfaces. For example, the deflector 40 can have a trapezoidal or triangular profile. The lower angled surface 44 can be complementary to the exterior surface 28 of the inlet housing 20. For example, the lower angled surface 44 can include the inner rim 46 shaped to complement a curved portion 49 in the inlet housing 20.

In the enlarged view of FIG. 13, the deflector 40 can be positioned adjacent the ring 16, with an exterior surface 42 abutting at least a portion of the ring 16 reducing or preventing the leakage of air therebetween. In this configuration, the lower angled surface 44 can guide airflow exhausting from the outlet 24 in a generally downward direction, illustrated, by way of example, by the primary air flow 62 and the secondary air flow 64. The set of guide vanes 50 can affect the airflow prior to the deflector 40, such as providing a directionality, or increasing or decreasing local pressures or air speeds, or can rectify cyclical pressure waves that can otherwise generate noise, thereby providing noise reduction. Similarly, the raised portion 29 can further downwardly influence the directionality of the airflow at the outlet 24 via flow attachment along the raised portion 29.

In one example, the horizontal, relative to level or the structure containing the ceiling fan 10, can define a line of delineation between determining a generally downward direction away from a ceiling versus a generally upward direction toward the ceiling. Thus, it should be understood that a downward direction need not be away from the ceiling in a perpendicular or orthogonal manner, but angled in a direction away from the ceiling, relative to a direction parallel to the ceiling, such as the horizontal. Non-limiting examples of angles in a generally downward direction can include 30-degrees, 45-degrees, 60-degrees, or any suitable angle between 0-degrees and 90-degrees, relative to the horizontal. It should be appreciated that the ceiling fan 10 may utilize variable angles, such as by varying or changing the deflector 40, as different angles may be beneficial to different environments, air flow speeds or volumes, or considering factors such as volume of the room or use within the room, in non-limiting example.

Turning to FIG. 14, the deflector 40 is positioned in the second position adjacent to the inlet housing 20 such that the inlet housing 20 and the deflector 40 abut each other. In this position, the inner rim 46 and the curved portion 49 can fit together, such as the deflector seating relative to the inlet housing 20. While shown as slightly spaced, it is contemplated that the inner rim 46 and the curved portion 49 are sized and shaped complementary to one another. Optionally, when in the second position or seated position, at least a portion of the exterior surface 28 of the inlet housing 20 and lower angled surface 44 of the deflector 40 abut or contact one another.

As illustrated, when seated, the deflector 40 is aligned with the raised portion 29 when in the second position. This alignment provides for a smooth transition on the downstream side of the raised portion 29 by the sloping portion 41.

In the second position, the outlet passage 128 includes the set of guide vanes 50 and the sloping portion 41. The deflector 40 guides air exhausting from the interior passage 123 or the blades 72 in a generally outward direction, in a direction generally perpendicular to the vertical direction defined through the outlet opening 124. In the second lower position, the flow of air is unobstructed by the lower angled surface 44 of the deflector 40, permitting the outward flow of air along the ceiling, opposed to the downward flow of air away from the ceiling when the deflector 40 is in the first position. It is further contemplated that the deflector 40 need not be limited to a first and second position as described herein, but can be positioned in variable positions, between the first position and the second position. In such a position, it is contemplated that the airflow can be exhausted from the outlet 24 in both a generally upward direction and a generally downward direction.

It is noted that the upper-most vane of the set of guide vanes 50 abuts the ring 16 of the outlet frame 14, which effectively prevents air escaping the plenum 100 above the upper-most vane and running along the ceiling. In most uses of the ceiling fan 10, it is not desirable for the air to run directly along the ceiling because the Coanda effect can lead to the air being entrapped against the ceiling. Additional, air exiting between the vanes of the set of guide vanes 50 can be carried by the air flow along the ceiling and not circulate within the room as desired.

In operation, air is drawn into the inlet opening 122 through the inlet 22 by the impeller 70. After entering the inlet opening 122, the air flow splits into the primary air flow 62 and the secondary air flow 64. When the primary air flow 62 and the secondary air flow 64 combine downstream of the impeller 70, the secondary air flow 64 functions more like a curtain to keep the primary air flow 62 from immediately re-entering the inlet 22, and creating an undesired recirculation flow, which does not flow throughout the room.

When the deflector is in the first raised position, the shape of the deflector 40 and the shape of the inlet housing 20 direct the air flow at the outlet 24 downward and away from the ceiling fan 10. That is, the air flow exiting the ceiling fan 10 makes a downward, non-zero angle with the horizontal.

The surface features of the inlet housing 20 such as the raised portion 29 enhance flow attachment to for improved control of the air flow direction in a downward direction, which is important for user satisfaction of the air circulation in a room.

When the deflector 40 in the second position, the primary air flow 62 is exhausted from the outlet 24 in more of a generally outward direction, as compared to when the deflector 40 is in the first position, because the deflector 40 no longer deflects the primary air flow 62. The secondary air flow 64 still functions like an air curtain to direct the primary air flow 62 from forming a recirculation loop.

While the deflector 40 is described as moving between the two positions in a binary manner, it should also be appreciated that an embodiment of the ceiling fan can be configured such that the actuator 90 can move the deflector in a continuous, cyclical manner, cycling between or among the first position or the second position, which the rate of variation can be controlled by the user. Such a system can provide for variation in the airflows generated from the ceiling fan 10.

Further, it is contemplated that the alignment of the top-most or upper most guide vane of the set of guide vanes 50 with the ring 16 and shroud 30 can reduces airflow leakage. Additionally, the alignment of the top-most of the set of guide vanes 50 with the ring 16 and shroud 30 can reduce noise.

Figure 15:
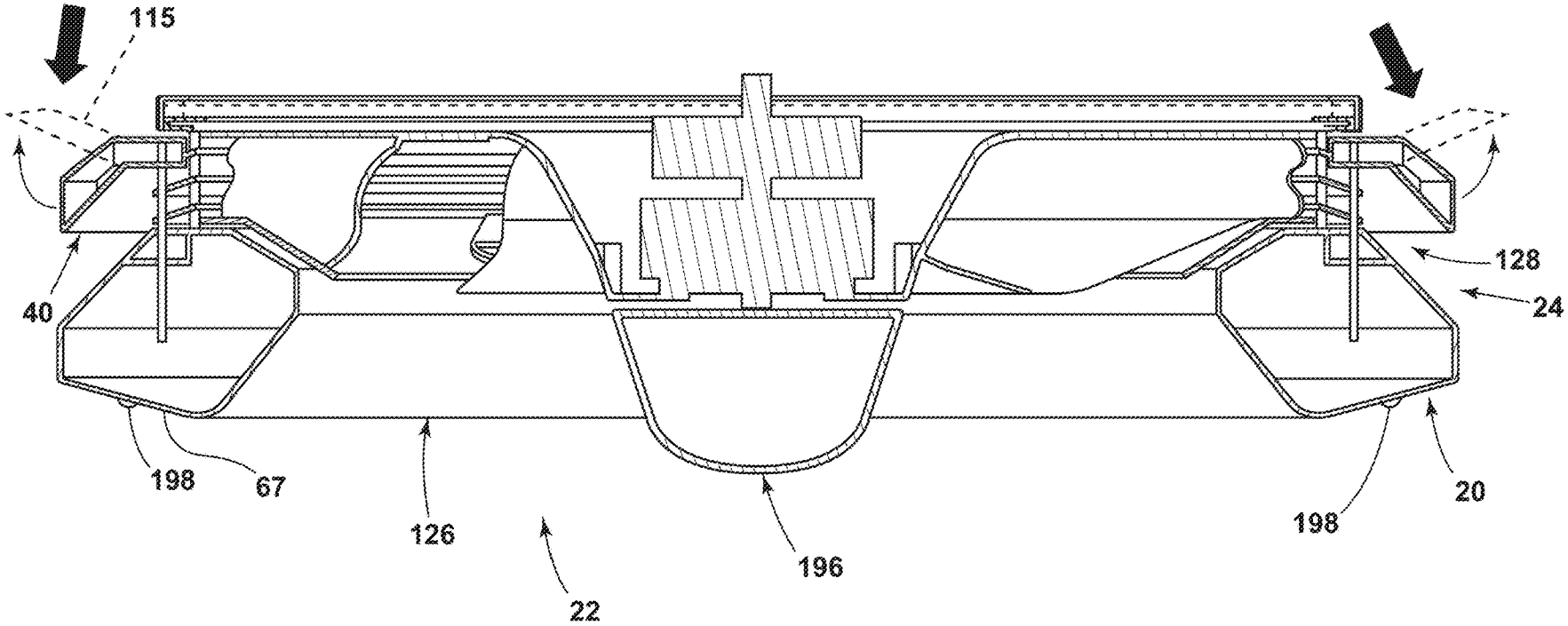
FIG. 15 is sectional view of the ceiling fan of FIG. 1 with an alternative shroud.

Referring to FIG. 15, variations to the embodiment shown in FIGS. 1-14 are shown. In one variation, a housing 196 can have a bullnose shape. Optionally, the housing 196 can include a light source or define a light kit. Benefits of the bullnose shape of the housing 196 is that the housing 196 does not interfere with the inlet air flow into the inlet 22 as much as the light kit 96 (FIG. 2 and FIGS. 11-14), where the light kit 96 is has an outwardly flared shape. The outwardly flared shape of the light kit 96 can negatively impact the air flow into the inlet opening, which can be compensated for by increasing the speed of the fan. However, increased fan speed results in increased noise, which is not desirable for most consumers.

In another variation, in addition to or in place of lights in the housing 196, lights 198 can be included in the inlet housing 20, such that light emanates from the lower surface 67. The lights 198 can be one or more LED lights, which can be mounted to the lower surface 67. Alternatively, lower surface 67 can be a non-opaque panel and the light 198 and reside inside the inlet housing 20, behind the non-opaque panel, and transmit light through the non-opaque panel.

In yet another variation, the deflector 40 can include a hinged portion 115, such that the angle of the deflector 40 can be altered by the user to improve the airflow as it moves through the outlet passage 128 and into the room. With this variation, not only can the deflector still move vertically, the deflector can also pivot and/or change its angle of attack to influence the direction of the air flow prior to exiting the ceiling fan 10 at the outlet 24.

There are many benefits to the ceiling fan as disclosed in the multiple embodiments. One of the benefits comes from the presence of the secondary air flow path regardless of the position of direction of the primary air flow path, which is a function of the deflector position. The deflector, regardless of its position, does not close the secondary air flow path. The secondary air flow path functions as a shield or curtain to prevent the primary air flow path from immediately turning as it leaves the outlet opening and re-entering the inlet opening to form an undesirable recirculation loop from the outlet opening, around the inlet body, and back into the inlet opening. The shielding function occurs primarily when the deflector is in the raised or deflecting position as shown in FIG. 13. The secondary air flow path also performs a guiding function to keep the primary air flow path from staying along the ceiling. The secondary air flow path is desirably higher speed that the primary air flow path, which generates a lower pressure area into which the primary air flow path is drawn. The lower pressure area will tend to draw the primary air flow path toward the secondary air flow path, which can happen regardless of whether the deflector is in the raised position (FIG. 13) or lowered position (FIG. 14), but is more beneficial in the lowered position as the lower pressure area draws the primary air flow path away from the ceiling to encourage better circulation. While the faster air flow in the secondary air flow path can draw the primary air flow path toward the secondary air flow path, the secondary air flow path still functions as a shield or curtain to prevent a recirculation loop. Thus, the always present secondary air flow path encourages better recirculation throughout the room in which the ceiling fan is located, regardless of the position of the deflector.

Although the embodiments of the present invention have been shown and described, it would be appreciated by those skilled in the art that changes may be made in these embodiments without departing from the principles and spirit of the invention. Although specific terms are employed herein, they are used in a generic and descriptive sense only and not for purposes of limitation.

This written description uses examples to disclose the invention, including the best mode, and to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A ceiling fan comprising:

a body defining a plenum with an inlet opening and an outlet opening;

an impeller having a set of blades located within the plenum;

a primary air flow path passing through the plenum from the inlet opening to the outlet opening;

a secondary air flow path extending from the inlet opening to the outlet opening and bypassing the set of blades;

a deflector moveable between a first position, where air from the primary air flow path is directed downwardly, and a second position, where the air from the primary air flow path is directed radially, without closing the secondary air flow path in either of the first position or the second position; and a set of guide vanes in the primary air flow path downstream of the impeller, and the set of guide vanes forming a non-zero angled relative to the horizontal, the non-zero angle being between 0 and −30 degrees.

2. The ceiling fan of claim 1 wherein the impeller defines at least a portion of both the primary air flow path and the secondary air flow path.

3. The ceiling fan of claim 1 wherein the set of guide vanes comprises an upper most guide vane sealed relative to the body.

4. The ceiling fan of claim 1 wherein all vanes in the set of guide vanes have the same angle.

5. The ceiling fan of claim 1 wherein the impeller includes an outer ring, with the set of blades having tips, which are mounted to the outer ring.

6. The ceiling fan of claim 5 wherein the set of blades are cantilevered from the outer ring.

* * * * *